United States Patent [19]

Matsubayashi

[11] Patent Number: 4,712,523

[45] Date of Patent: Dec. 15, 1987

[54] AIR-FUEL MIXTURE INTAKE PIPE FOR INTERNAL COMBUSTION ENGINE

[75] Inventor: Tatsuhiko Matsubayashi, Hachioji, Japan

[73] Assignee: Kioritz Corporation, Tokyo, Japan

[21] Appl. No.: 864,093

[22] Filed: May 19, 1986

[30] Foreign Application Priority Data

Jun. 4, 1985 [JP] Japan ..... 60-83451[U]

[51] Int. Cl.[4] ..... F02M 29/04; F02M 33/02

[52] U.S. Cl. ..... 123/188 M; 123/591; 123/593

[58] Field of Search ..... 123/188 M, 590, 593, 123/591, 52 MF

[56] References Cited

U.S. PATENT DOCUMENTS 4,359,997 11/1982 Lyssy ..... 123/188 M
4,474,163 10/1984 Linder et al. ..... 123/188 M

FOREIGN PATENT DOCUMENTS 541731 1/1932 Fed. Rep. of Germany ..... 123/52 MF
755191 11/1933 France ..... 123/593

*Primary Examiner*—Craig R. Feinberg
*Attorney, Agent, or Firm*—Browdy and Neimark

[57] ABSTRACT

An air-fuel mixture intake pipe for an internal combustion engine, wherein a plurality of projection rows each composed of a plurality of projections spaced from each other on an inner wall of the intake pipe and arranged in a circumferential direction are spaced from each other rows in a longitudinal direction of the intake pipe, and a space of each adjacent projections is defined by a longitudinal groove.

3 Claims, 3 Drawing Figures

AIR-FUEL MIXTURE INTAKE PIPE FOR INTERNAL COMBUSTION ENGINE

BACKGROUND OF THE INVENTION (1) Field of the Invention

The present invention relates to an improvement in an intake pipe for communicating a carbureter and an intake port of a cylinder of an internal combustion engine such as a two-cycle engine.

(2) Description of the Prior Art

Conventionally, such an intake pipe has been typically provided with a smooth inner wall surface. This known type intake pipe has been widely used in general.

In case of the intake pipe having a smooth inner wall, when a throttle valve is abruptly returned from a full throttle condition back to an idle operation, the intake inertia causes the supplied amount of fuel to be temporarily excessive. As a result, the engine would be stalled. In order to avoid such a phenomenon, it is necessary to make leaner a carburetor set value upon the idle operation than that during the normal operation. This makes it possible to prevent the engine from stalling when the throttle valve is abruptly returned back to the idle operation, but inversely an acceleration performance would be suppressed. In order to solve this incompatible problem, it has been proposed to provide an intake pipe with a number of continuous pleats in a circumferential direction as shown in Japanese Utility Model Unexamined Publication No. 51009/1985. However, this has not yet been satisfactory.

SUMMARY OF THE INVENTION (1) Object of the Invention

In order to overcome the above noted defects, an object of the present invention to provide an air-fuel mixture intake pipe having a simple construction for obviating drawbacks such as the intake inertia problem.

(2) Statement of the Invention

According to the present invention, a plurality of projection rows each composed of a plurality of projections spaced from each other on an inner wall of the intake pipe and arranged in a circumferential direction are spaced from each other with the rows extending in a longitudinal direction of the intake pipe, and a space between each pair of each adjacent projections is defined by a longitudinal or axial groove. With such an arrangement, excessive raw fuel is stagnant between the projections upon the abrupt deceleration of the engine, and upon the re-acceleration of the engine, the stagnant fuel is made to flow suitably while being evaporated at the grooves between the projections, so that the acceleration performance is enhanced and it is possible to set the carburetor level at an as-normal value or more upon the engine idle condition. Thus, the acceleration performance may be further improved.

The intake pipe may be integrally formed of elastic material such as synthetic rubber or the like.

DESCRIPTION OF THE PREFERRED EMBODIMENT

The present invention will now be described with reference to the accompanying drawings.

Figure 1:
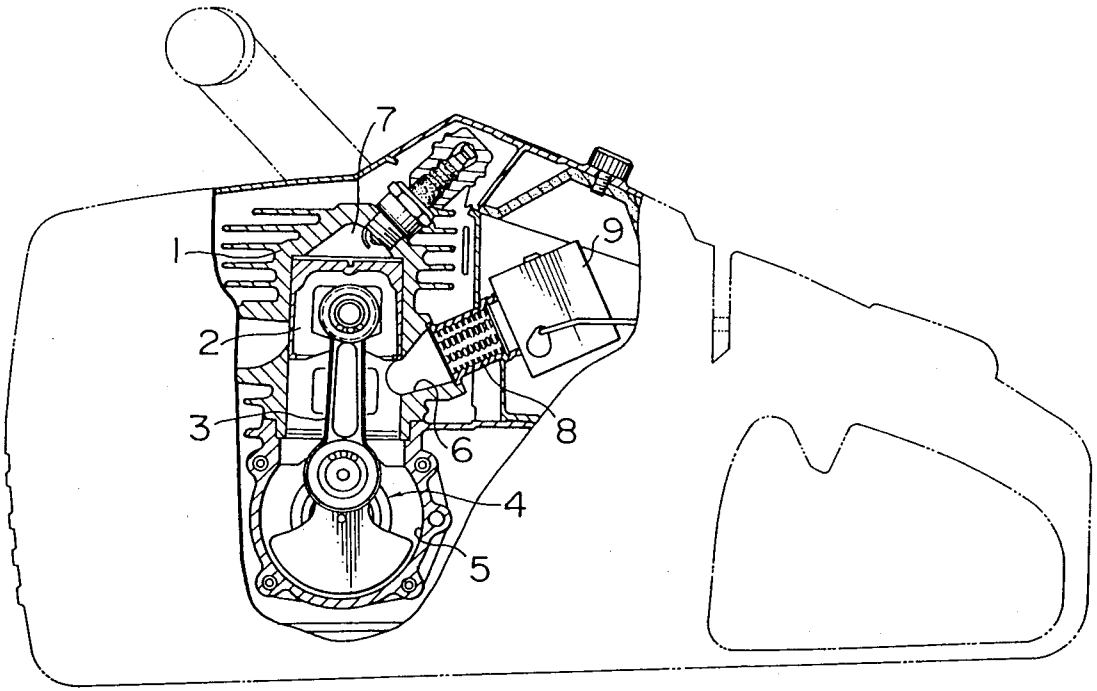
FIG. 1 is a partially fragmentary cross-sectional view of a primary part of a two-cycle engine provided with an intake pipe in accordance with the invention.

As shown in FIG. 1, a two-cycle engine used as a power source of a portable type power-driver machine includes a cylinder 1, a piston 2 reciprocating within the cylinder 1, and a crank shaft 4 connected to the piston 2 by a connecting rod 3. As is well known, in the two-cycle engine, the crank shaft 4 is rotated within a crank case 5, a fresh air-fuel mixture is sucked through an intake port 6 formed in a side wall of the cylinder 1, and the mixture is pre-compressed in the crank case 5 as the crank shaft rotates, and the mixture is fed into a combustion chamber 7 above the piston 2 within the cylinder 1 at a predetermined timing. The intake port 6 communicates with a carbureter 9 through an intake pipe 8. The air-fuel mixture is fed from the carburetor 9.

Figure 2:
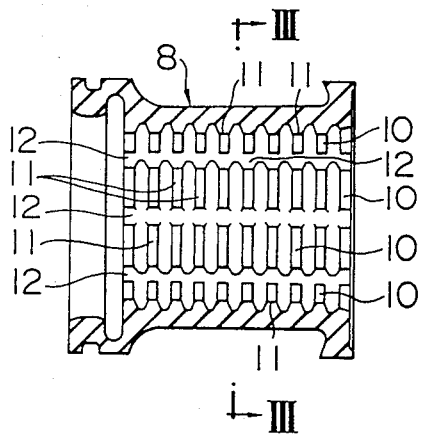
FIG. 2 is a longitudinal sectional view of the intake pipe shown in FIG. 1.
Figure 3:
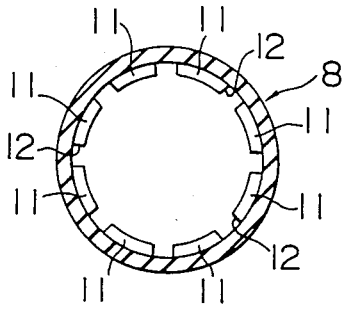
FIG. 3 is a cross-sectional view taken along the line III—III of FIG. 2.

According to the present invention, the intake pipe 8 is integrally formed of elastic material such as synthetic rubber. As best shown in FIGS. 2 and 3, a plurality of projection rows 10 arranged in a circumferential direction and spaced from each other are provided in the longitudinal direction of the inner wall. Each of the projection rows 10 is composed of a plurality of projections 11 spaced from each other. A gap between the adjacent projections 11 of each projection row 10 is aligned with a gap between the adjacent projections 11 of the adjacent (in the axial direction) other projection row, thereby defining a longitudinal groove 12 extending in the longitudinal direction of the intake pipe 8 from the carburetor 9 to the intake port 6.

With such an arrangement, upon the operation of the engine, the air-fuel mixture is made to flow through the intake pipe 8 from the carbureter 9 to the cylinder intake port 6 as in the prior art. As described before, upon the abrupt deceleration or the like, an excessive air-fuel mixture flows through the intake pipe 8 from the carbureter 9. However, the fuel droplets contained in the mixture is stagnant between the projections 11 on the inner wall surface of the intake pipe 8 and upon the re-acceleration of the engine, the stagnant fuel smoothly flows along the longitudinal grooves 12 while being evaporated from between the projections 11 to thereby enhance the acceleration performance. At the same time, upon the abrupt engine operation mode change to the acceleration, the fuel may be sufficiently supplied until fresh fuel is supplied from the carburetor.

Also, with the arrangement in which the plurality of projections 11 are provided in the circumferential direction to form the projection rows, when the engine posture is changed in the idle operation, the fuel stagnant between the projections 11 is prevented from being supplied at once. If the fuel would be supplied at once, a concentration of fuel would be excessive to stall the engine undesirably.

What is claimed is:

1. An air-fuel mixture intake pipe for an internal combustion engine, adapted to communicate a carburetor of the internal combustion engine and an intake port of a cylinder thereof, said intake pipe comprising means for containing stagnate excess fuel during sudden deceleration and evaporation said excess fuel during re-acceleration so as to be gradually supplied to said engine, said means including a wall on an interior of the intake pipe which a plurality of projection rows are molded integrally therewith to provide a hollow, elongated passage for said air-fuel mixture between said carburetor and intake port, each said projection being composed of a plurality of projections spaced from each other extending along and slightly into said interior of said wall of the intake pipe and, said projections being arranged in a circumferential direction and spaced from each other with said rows extending in a longitudinal direction of the intake pipe, and a space defined between each adjacent pair of said rows of projections by a longitudinal groove formed in said inner wall of the intake pipe;

wherein when said engine is suddenly decelerated, said excess fuel in said air-fuel mixture stagnates between said projections, and when said engine is re-accelerated, the stagnant fuel evaporates from said projections and flows along said longitudinal grooves to be gradually supplied for combustion.

2. An air-fuel mixture intake pipe according to claim 1, wherein said intake pipe having said rows of projections in its inner wall is formed of elastic material.

3. An air-fuel mixture intake pipe according to claim 2, wherein said elastic material comprises synthetic rubber.

* * * * *